US005706680A

United States Patent [19]

Wroble

[11] Patent Number: 5,706,680

[45] Date of Patent: Jan. 13, 1998

[54] SURFBOARD LOCKS

[76] Inventor: Ronald G. Wroble, 6065 Barranco Ave., Port St. John, Fla. 32927

[21] Appl. No.: 578,908

[22] Filed: Dec. 27, 1995

[51] Int. Cl.[6] ..... E05B 73/00

[52] U.S. Cl. ..... 70/18; 70/58; 211/4; 224/323; 441/74

[58] Field of Search ..... 70/14, 18, 58, 70/15, 19, 57, 62; 248/552; 211/4, 60.1; 441/74, 75; 224/315, 323, 319, 917

[56] References Cited

U.S. PATENT DOCUMENTS

| | | | |
|---|---|---|---|
| 3,719,297 | 3/1973 | Nowicki | 224/315 X |
| 3,905,214 | 9/1975 | Bell | 70/58 |
| 3,985,275 | 10/1976 | Allen | 70/58 X |
| 4,057,983 | 11/1977 | Morgan | 70/58 X |
| 4,059,209 | 11/1977 | Grisel | 70/58 X |
| 4,261,496 | 4/1981 | Mareydt et al. | 224/319 X |
| 4,267,615 | 5/1981 | Nealy | 9/310 E |
| 4,340,376 | 7/1982 | Williams | 70/58 X |
| 4,469,260 | 9/1984 | Delahanty | 224/319 X |
| 4,680,949 | 7/1987 | Stewart | 70/14 |
| 4,712,394 | 12/1987 | Bull | 70/18 |
| 4,728,019 | 3/1988 | Olliges | 224/323 X |
| 4,773,239 | 9/1988 | Lowe et al. | 70/38 A |
| 4,804,347 | 2/1989 | Ross | 441/79 |
| 4,867,362 | 9/1989 | Finnegan et al. | 224/315 X |
| 4,896,519 | 1/1990 | Pitts | 70/18 X |
| 5,020,342 | 6/1991 | Doan et al. | 70/DIG. 63 X |
| 5,067,644 | 11/1991 | Coleman | 224/319 X |
| 5,127,861 | 7/1992 | Ross | 441/75 |
| 5,179,847 | 1/1993 | Dorn | 70/58 X |
| 5,265,449 | 11/1993 | Rashleigh | 70/58 X |
| 5,350,097 | 9/1994 | Walter | 224/315 |
| 5,440,907 | 8/1995 | Shen | 70/209 |
| 5,582,044 | 12/1996 | Bolich | 70/58 |

FOREIGN PATENT DOCUMENTS

| | | | |
|---|---|---|---|
| 0031963 | 7/1981 | European Pat. Off. | 224/315 |
| 2481209 | 10/1981 | France | 224/315 |
| 2700796 | 7/1978 | Germany | 70/58 |
| 2705241 | 8/1978 | Germany | 70/58 |
| 0153865 | 2/1982 | Germany | 224/315 |
| 3103783 | 9/1982 | Germany | 441/74 |
| 493309 | 10/1938 | United Kingdom | 70/227 |

*Primary Examiner*—Lloyd A. Gall
*Attorney, Agent, or Firm*—Brian S. Steinberger; Law Offices of Brian S. Steinberger

[57] ABSTRACT

Locking devices for surfboards, sailboards and skateboards which clamp about tapered sides of surfboards and sailboards adjacent the fins. The devices clamp about skateboard sides between the two sets of wheels. One version has a hook ended rod that grips about a board side and another end that attaches by a padlock to a second rod which hooks about another board side. The first rod end has through holes that insert into a cylinder end of the second rod. The further one rod is inserted into the second cylindrical rod end, the closer the spacing between the hooks. A padlock in the through-holes connect the rods. Another version has a padlock in the second cylindrical rod where grooves on the first rod end are locked in place. Another version has a perpendicular extension bracket that wraps about one surfboard or sailboard fin. Another version uses a top flat plate that hingedly connects to a curved bottom plate. Opposite ends of the plates have matching through-holes for a padlock. Another version has side-by-side holes in both plates to accommodate different board widths. A cable connects the devices to a pole or bikerack.

6 Claims, 10 Drawing Sheets

Fig.7A
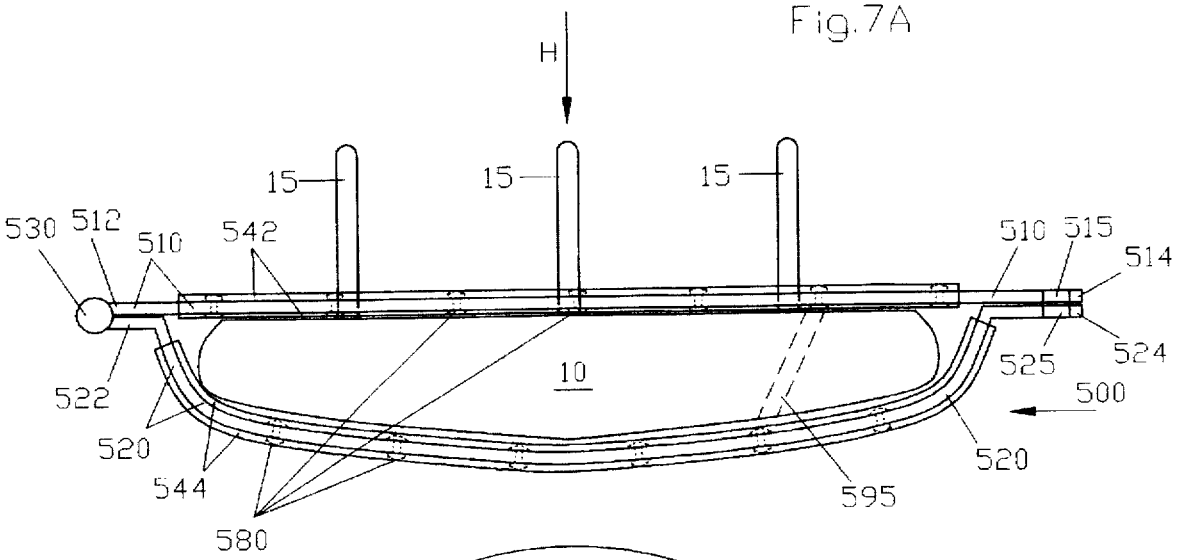
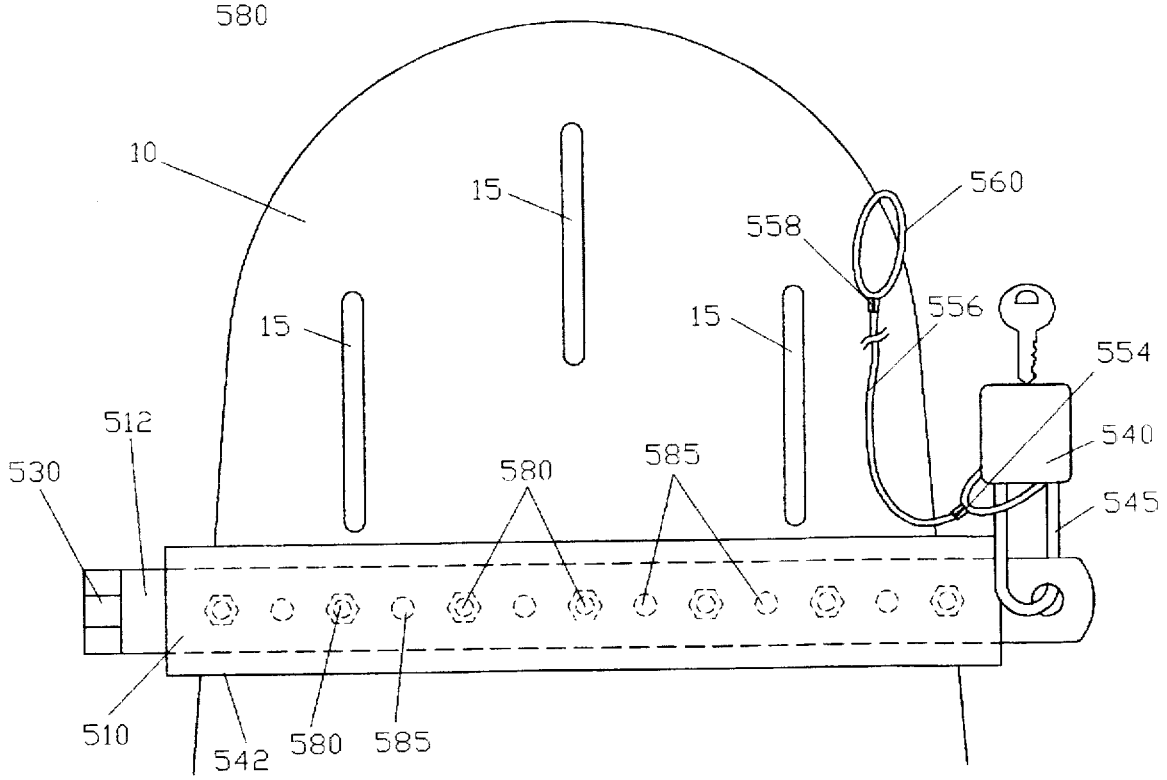
Fig.7B

SURFBOARD LOCKS

This invention relates to locking devices, and in particular to locking devices for recreation boards such as surfboards, skateboards, sail boards, and wind suffers that protect or restrict the theft of the recreation board.

BACKGROUND AND PRIOR ART

Various types of surfboards have become quite popular in recent years and generally cost from a few hundred dollars to over a thousand dollars. In view of their popularity and cost, surfboards are being more frequently stolen. Because of their unique board shape, traditional types of locks used for other recreational items such as bicycles are unsuitable for locking a surf board. Thus, a simple cable and lock cannot adequately lock a surfboard. Several U.S. patents have issued for attempting to safeguard a surfboard. U.S. Pat. No. 4,712,394 to Bull describes a "surf lock." However, this patent requires forming a passageway 3, FIG. 1 through the surfboard itself in order to attach a cable and lock, in effect damaging the board. U.S. Pat. No. 5,127,861 to Ross also requires a through-hole 20–27 FIG. 1 into the board itself in order to mount a cable and lock. Other types of attachments for surfboards have included leashes connected to permanently mounted inserts on the boards. See for example: U.S. Pat. No. 4,267,615 to Nealy. However, the purpose of the leash is generally for allowing the surfer to stay connected to the surfboard in case of a wipeout. Leashes are generally flexible strands such as leather or cables that can be cut. Further, a thief does not have to remove the leash in order to ride the board. Leashes are not a deterrent for surfboard theft. Thus, the need exists for a solution to the above listed problems.

SUMMARY OF THE INVENTION

The first objective of the present invention is to provide a locking device for a surfboard that prohibits or restricts the theft of the surfboard.

The second object of this invention is to provide locking devices for surfboards that do not damage nor alter the surfboard itself.

The third object of this invention is to provide locking devices for surfboards that can easily be utilized when needed.

The fourth object of this invention is to provide locking devices for surfboards that does not allow the surfboard to be used unless the locking device is removed.

The fifth object of this invention is to provide a brightly colored locking device that sticks out as a deterrent to would be thieves.

Several versions of the novel locking device are disclosed. The locking device includes a first rod having an elongated end and a curved end for wrapping about one side of a recreation board, a second rod having an elongated end and a curved end for wrapping about a second side of the recreation board, the second side being opposite to the first end, and a padlock for attaching the first rod elongated end to the second rod elongated end. The recreation board can include a surfboard, sailboard and skateboard. The locking device can fit across the tapered sides of the surfboard, the tapered sides of the sailboard, or the area between the two wheel sets of the skateboard. The padlock can include a combination lock, key lock and fixed lock. The rods can be connected by having one rod telescoping into the cylindrical end of the second rod. Plural through-holes on each rod allow for at least a pair to match up and to connect the padlock therethrough. An optional cable having a first loop end and a second loop end, the first loop end can be attached to the second rod. Furthermore, a perpendicular bracket can be attached to an exterior surface of the second rod and have an opening for fitting about a fin on the recreation board. Each of the rods can include second cushion sleeves for protecting the sides of the boards. Other versions of the locking device include a top plate having a through-hole on one end and a hinge on the opposite end. The hinge being connected to a curved bottom plate where both the top plate and the curved bottom plate having a through-hole on one end. The top plate and the bottom curved plate rotate relative to the hinge and abut against opposite sides of a recreation board so the through-holes of each plate match together, and a padlock connects into the through-holes. Rubber cushion sleeves can be wrapped about both plates, and an optional cable can be attached to the top plate. Both the top plate and the bottom plate can have additional side-by-side through-holes so that the width of this version can be varied. A still another version has a cable connected at one end to a biting clamp and a free end that wraps about a recreation board and is held in place by a lock on the biting clamp.

Further objects and advantages of this invention will be apparent from the following detailed description of a presently preferred embodiment which is illustrated schematically in the accompanying drawings.

BRIEF DESCRIPTION OF THE FIGURES

FIG. 7A is a side view of a fifth preferred embodiment of the invention applied to the prior art surfboard/sailboard of FIG. 1A.

FIG. 7B is a top partial view of the fifth preferred embodiment of FIG. 7A along arrow H.

DESCRIPTION OF THE PEERED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1B:
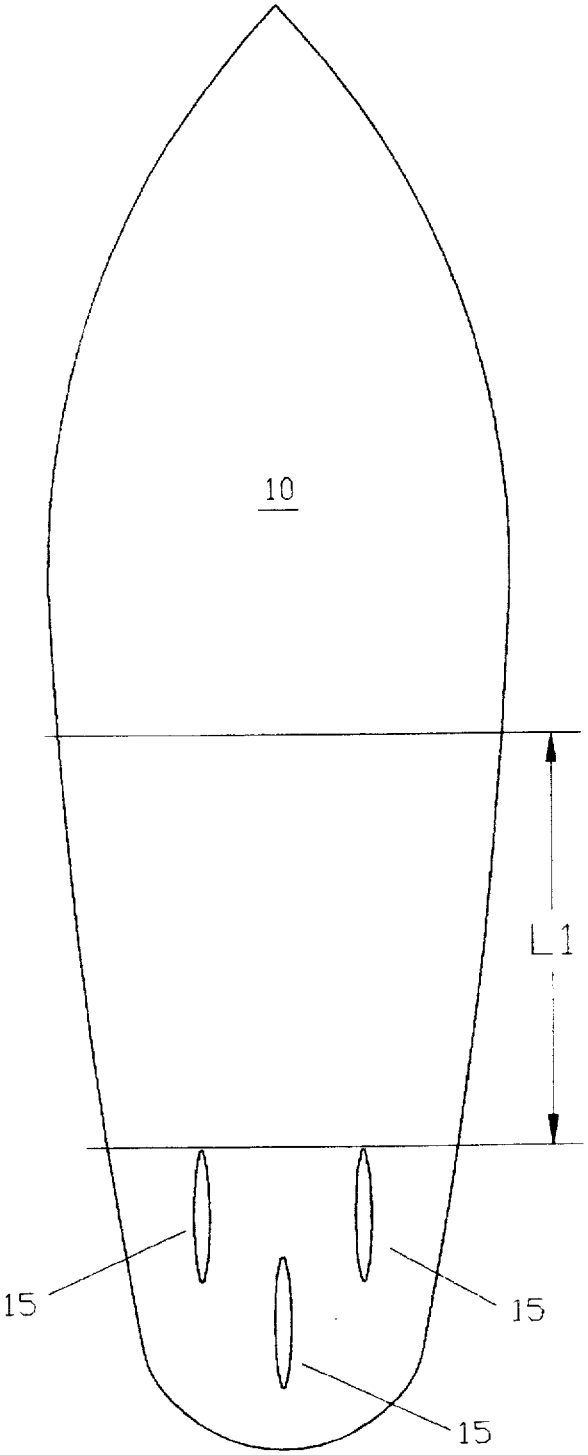
FIG. 1B is a top view of the prior art surfboard and sailboard of FIG. 1A.
Figure 1A:
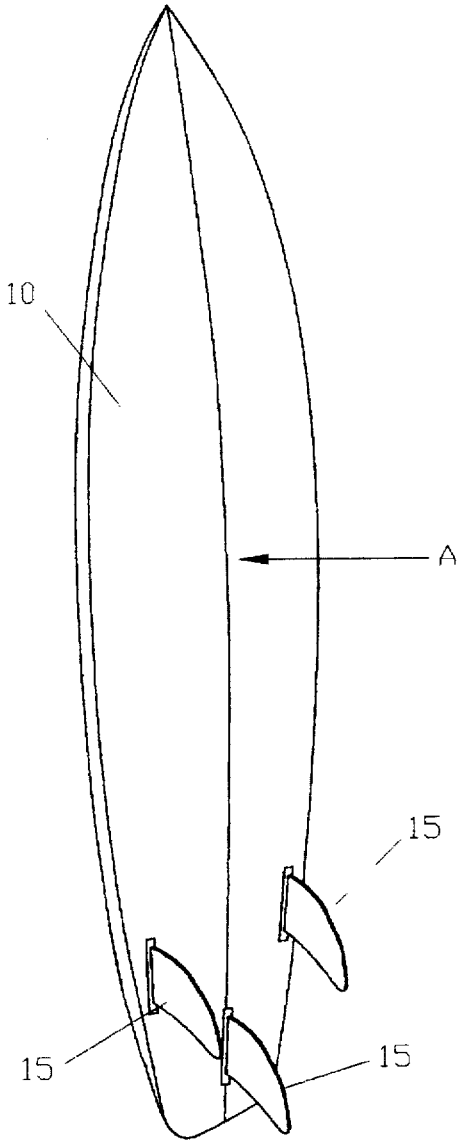
FIG. 1A is a perspective view of a prior art surfboard and prior art sailboard that uses the subject invention.
Figure 2B:
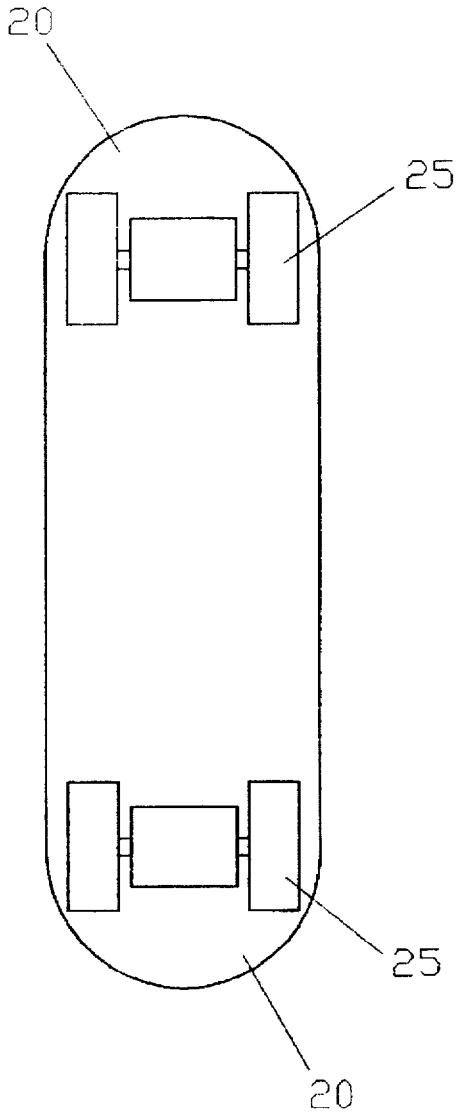
FIG. 2B is a bottom view of the prior skateboard of FIG. 2A.
Figure 2A:
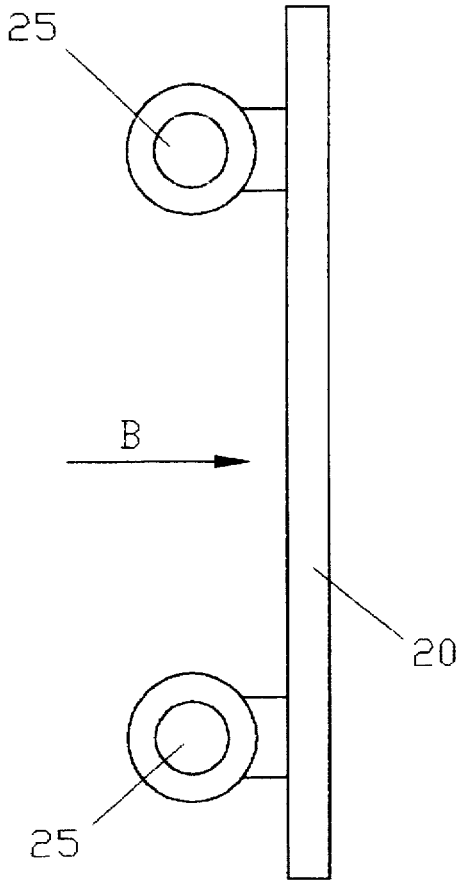
FIG. 2A is a side view of a prior art skateboard that uses the subject invention.

FIG. 1A is a perspective view of a prior art surfboard 10 and prior art sailboard 10 and fins 15. FIG. 1B is a top view of the prior art surfboard and sailboard 10 with fins 15 of FIG. 1A along arrow A. FIG. 2A is a side view of a prior art skateboard 20 with wheels 25. FIG. 2B is a bottom view of the prior skateboard 20 with wheels 25 of FIG. 2A. Both the prior art surfboard/sailboard and skateboard of the preceding figures can use the subject invention.

FIRST PREFERRED EMBODIMENT

Figure 3A:
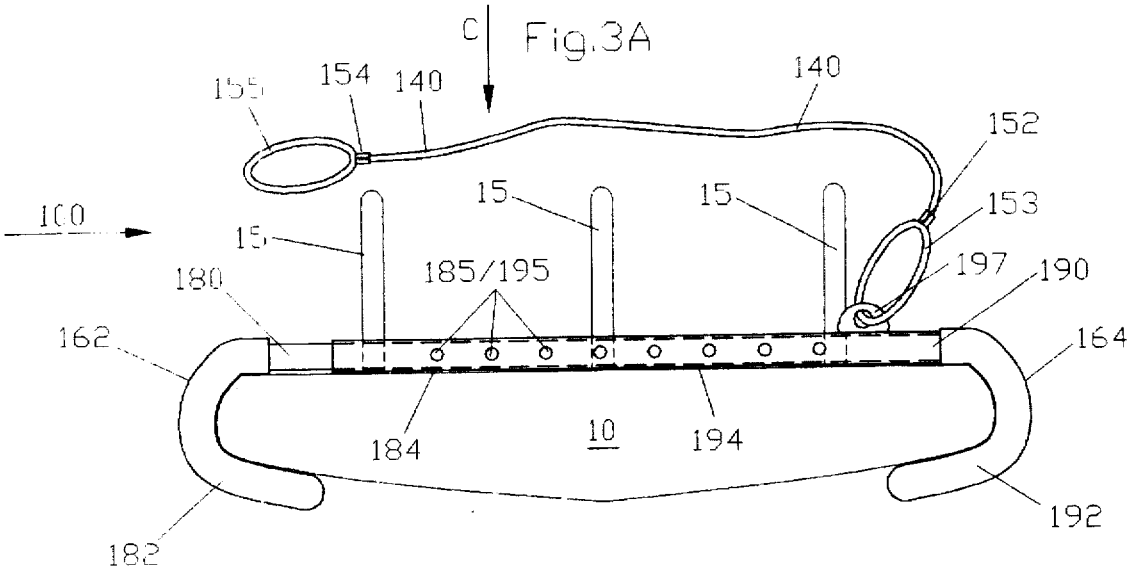
FIG. 3A is a side view of a first preferred embodiment of the invention applied to the prior art surfboard/sailboard of FIG. 1A.
Figure 3B:
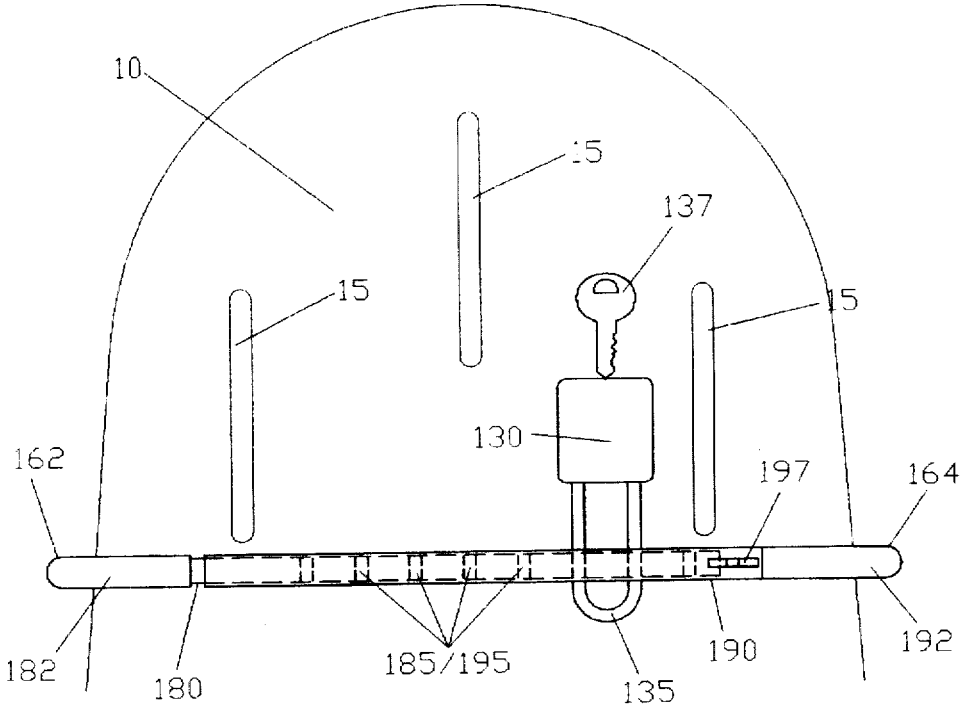
FIG. 3B is a top partial view of the first preferred embodiment of FIG. 3A along arrow C.

FIG. 3A is a side view of a first preferred embodiment 100 applied to the prior art surfboard/sailboard 10 of FIG. 1A. FIG. 3B is a top partial view of the first preferred embodiment 100 of FIG. 3A along arrow C. Referring to FIGS. 3A–3B, embodiment 100 includes a left rod pipe 180 with a diameter of approximately ⅝ inches has a inwardly curved portion 182 covered by a cushion sleeve 162, with a portion 184 having holes 185 drilled therethrough. A fight rod 190 with a diameter of approximately ¾ inches has an opposite inwardly curved portion 192 covered by a cushion sleeve 164, with a hollow cylindrical portion 194 also having holes 195 drilled therethrough. A flexible cable 140 such as a plastic coated metal strands, can be connected by a clamping means 152 to a loop portion 153 which fits about a metal loop connector 197 which is fixably attached to the side of rod 190 by soldering, welding and the like. Opposite end of the cable 140 can be fixably clamped 154 to a similar loop 155 so that the entire locking device 100 can be attached to a support structure such as but not limited to a sign pole, meter, bike rack, car rack and the like. Generic lock 130 can be a key lock or combination padlock such as those manufactured by Master Lock®. Rods 180 and 190 can be formed from materials such as but not limited to stainless steel, galvanized steel, metal alloys, hardened plastic, fiberglass and the like. Rubber cushion sleeves 162 and 164 can be formed from rubber, nylon, plastic and combinations thereof. Either or both the cushion sleeves 162, 164 and/or the rods 180, 190 and/or the cable components 140, 153, 155 can be coated with a neon colored paint and the like such as bright orange or yellow for added visibility. In operation, cylindrical hollow portion 194 receives rod portion 184 and holes 185/195 can be matched up so that a genetic lock 130 having a U shaped end 135 can be inserted into the holes. The rubber cushion sleeves 162, 164 fit about the sides of a surfboard 10 in the tapered area shown as L1 in FIG. 1B and remain fixably secured in area L1 until locking device 100 is removed. Similarly, locking device 100 can be fitted about the sides of the skateboard 20 of FIG. 2B in the area depicted by L2.

SECOND PREFERRED EMBODIMENT

Figure 4A:
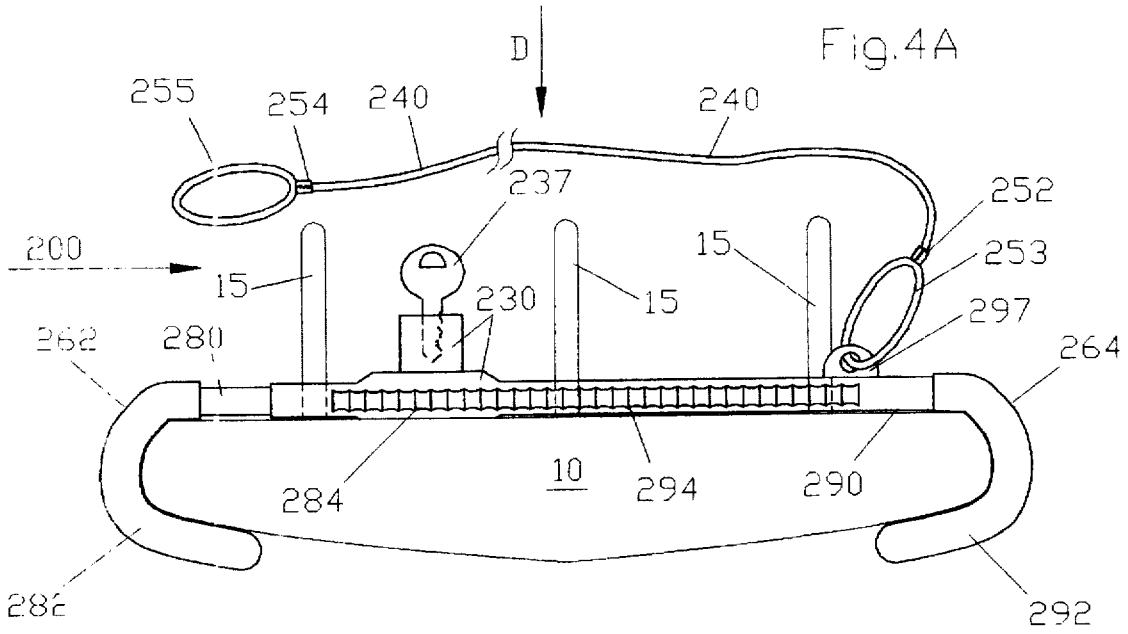
FIG. 4A is a side view of a second preferred embodiment of the invention applied to the prior art surfboard/sailboard of FIG. 1A.
Figure 4B:
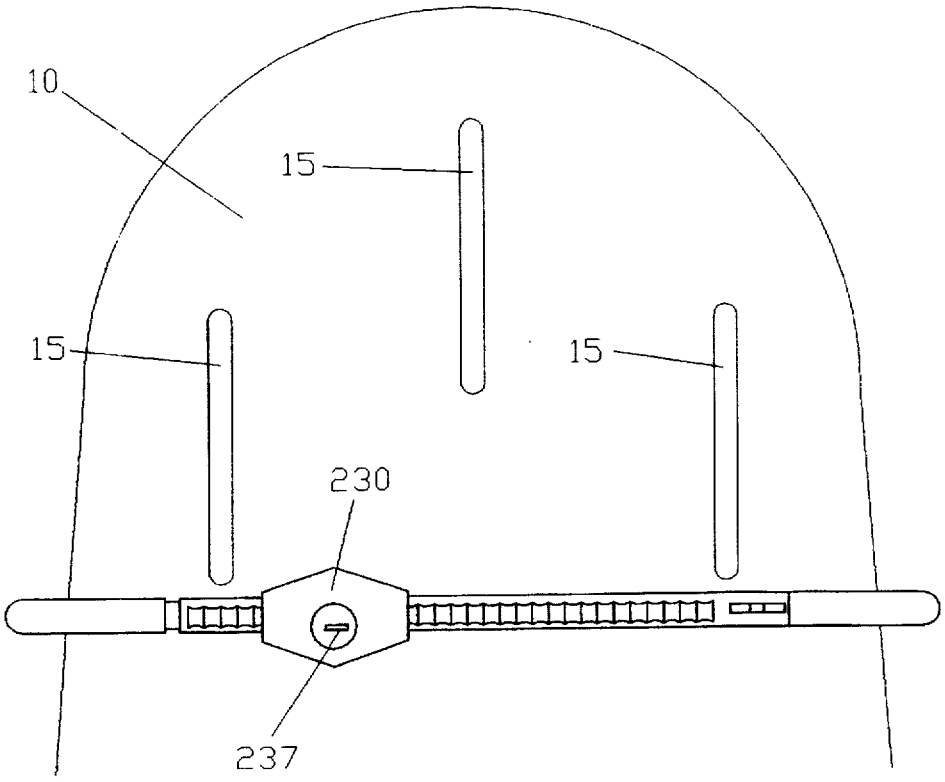
FIG. 4B is top partial view of the second preferred embodiment of FIG. 4A along arrow D.

FIG. 4A is a side view of a second preferred embodiment 200 applied to the prior art surfboard/sailboard 10 of FIG. 1A. FIG. 4B is top partial view of the second preferred embodiment 200 of FIG. 4A along arrow D. Referring to FIGS. 4A–4B, embodiment 200 includes a left rod pipe 280 with a diameter of approximately ⅝ inches has an inwardly curved portion 282 covered by a cushion sleeve 262, with a portion having cylindrical indented ridges 284. A right rod 290 with a diameter of approximately ¾ inches has an opposite inwardly curved portion 292 covered by a cushion sleeve 264, with a hollow cylindrical portion 294. A flexible cable 240 such as a plastic coated metal strands, can be connected by a clamping means 252 to a loop portion 253 which fits about a metal loop connector 297 which is fixably attached to the side of rod 290 by soldering, welding and the like. Opposite end of the cable 240 can be fixably clamped 254 to a similar loop 255 so that the entire locking device 200 can be attached to a support structure such as but not limited to a sign pole, meter, bike rack, car rack and the like. Generic lock 230 can be a key lock such as those manufactured by the Club®, Rally Accessories®, and the like. Rods 280 and 290 can be formed from materials such as but not limited to stainless steel, galvanized steel, metal alloys, hardened plastic, fiberglass and the like. Rubber cushion sleeves 262 and 264 can be formed from rubber, nylon, plastic and combinations thereof. Either or both the cushion sleeves 262, 264 and/or the rods 280, 290 and/or the cable components 240, 253, 255 can be coated with a neon colored paint and the like such as bright orange or yellow for added visibility. In operation, cylindrical hollow portion 294 receives rod portion 280 with cylindrical indentations 284 for key lock 230. The rubber cushion sleeves 262, 264 fit about the sides of a surfboard 10 in the tapered area shown as L1 in FIG. 1B and remain fixably secured in area L1 until locking device 200 is removed. Similarly, locking device 200 can be fit about the sides of the skateboard 20 of FIG. 2B in the area depicted by L2.

THIRD PREFERRED EMBODIMENT

Figure 5A:
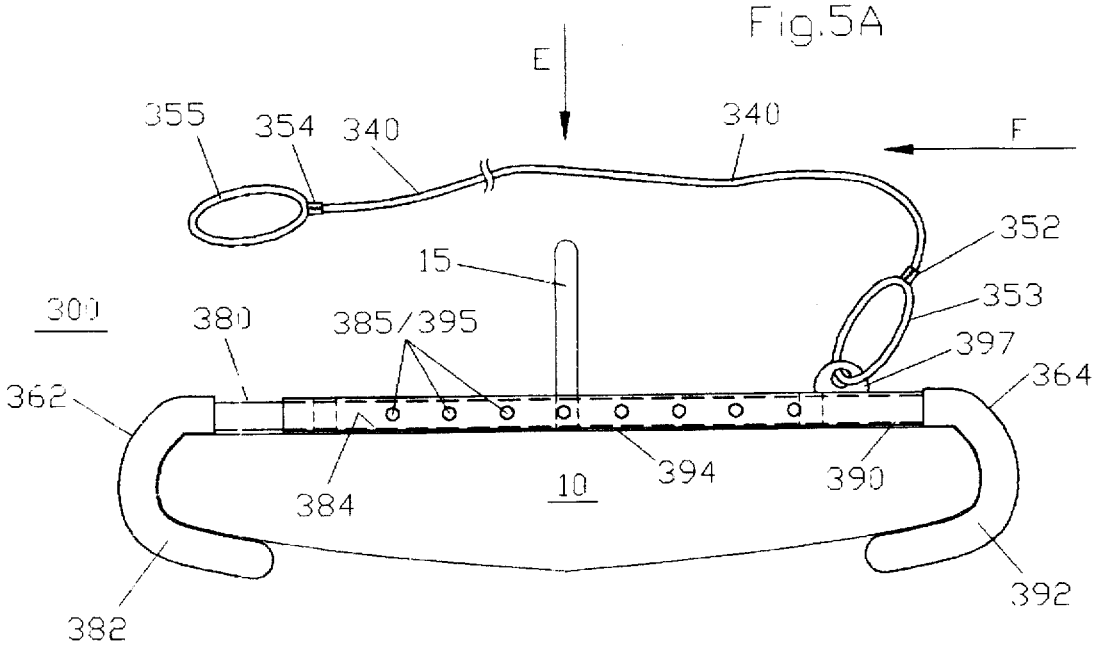
FIG. 5A is a side view of a third preferred embodiment of the invention applied to the prior art surfboard/sailboard of FIG. 1A.
Figure 5B:
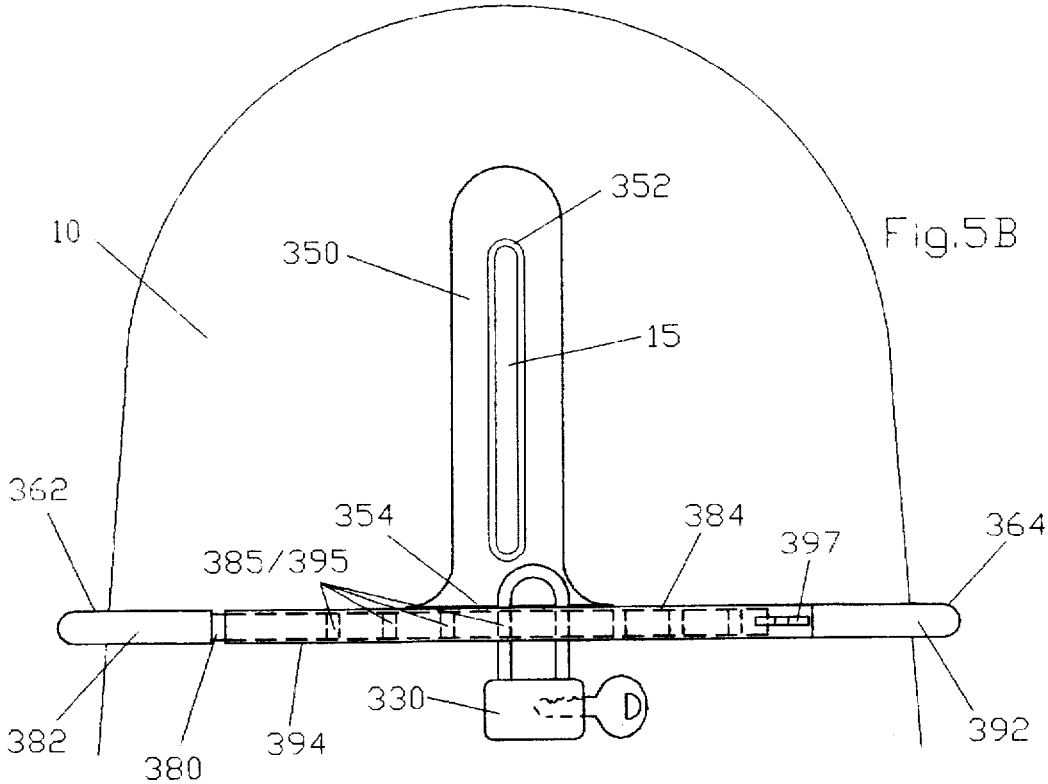
FIG. 5B is a top partial view of the third preferred embodiment of FIG. 5A along arrow E.
Figure 5C:
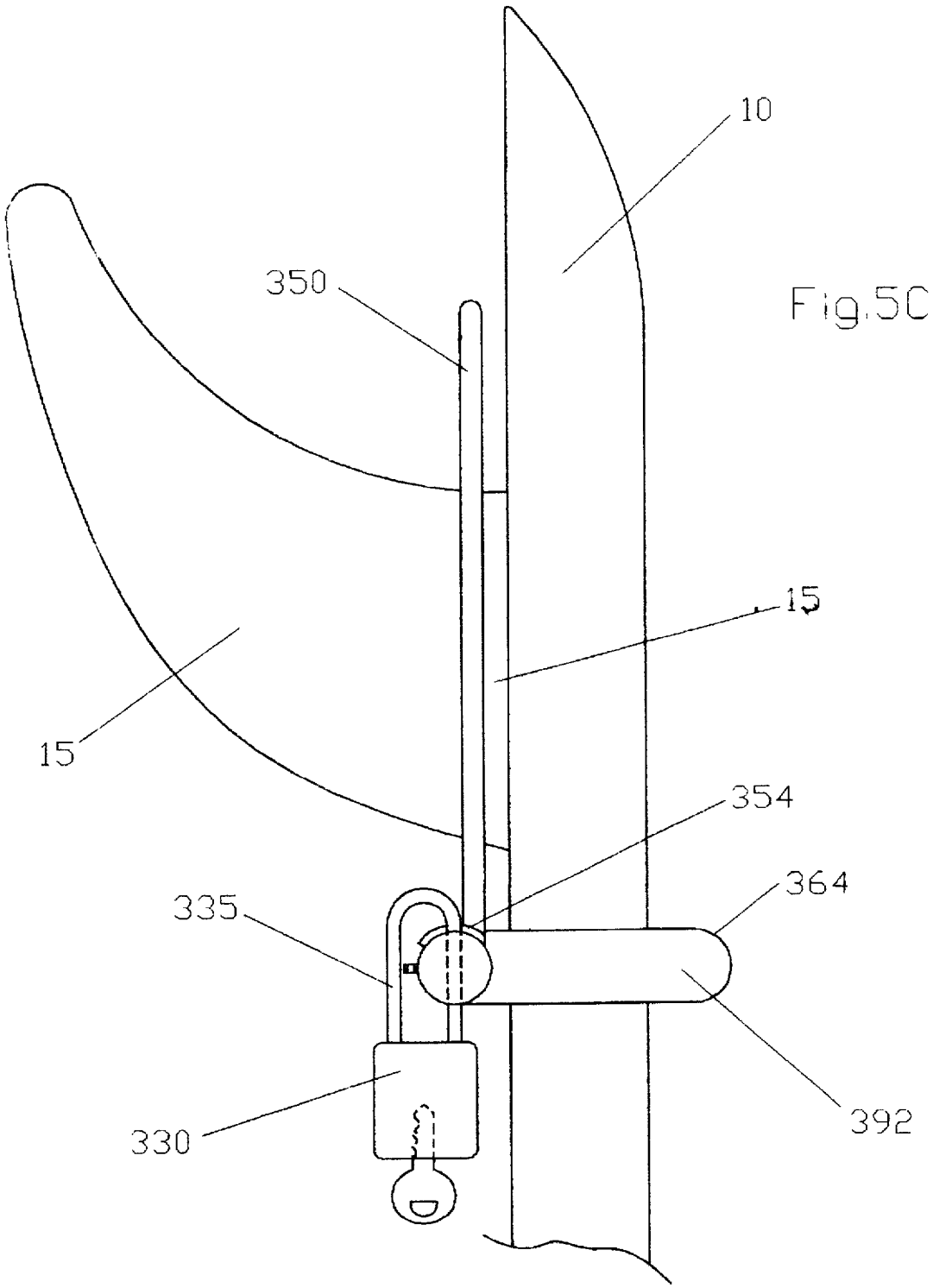
FIG. 5C is a partial view of the third preferred embodiment of FIG. 5A along arrow F.

FIG. 5A is a side view of a third preferred embodiment 300 applied to the prior art surfboard/sailboard 10 of FIG. 1A. FIG. 5B is a top partial view of the third preferred embodiment 300 of FIG. 5A along arrow E. FIG. 5C is a partial view of the third preferred embodiment 300 of FIG. 5A along arrow F. Referring to FIGS. 5A–5C, embodiment 300 includes a left rod pipe 380 with a diameter of approximately ⅝0 inches has a inwardly curved portion 382 covered by a cushion sleeve 362, with a portion 384 having holes 385 drilled therethrough. A right rod 390 with a diameter of approximately ¾ inches has an opposite inwardly curved portion 392 covered by a cushion sleeve 364, with a hollow cylindrical portion 394 also having holes 395 drilled therethrough. A metal bracket 350 formed of the same materials as that of rods 380, 390 has an opening 352 sized to fit over a fin 15 on a board 10. Bracket 350 can be fixably attached at 354 to the exterior surface 394 of rod 390 by soldering welding and the like. A flexible cable 340 such as a plastic coated metal strands, can be connected by a clamping means 352 to a loop portion 353 which fits about a metal loop connector 397 which is fixably attached to the side of rod 390 by soldering, welding and the like. Opposite end of the cable 340 can be fixably clamped 354 to a similar loop 355 so that the entire locking device 300 can be attached to a support structure such as but not limited to a sign pole, meter, bike rack, car rack and the like. Genetic lock 330 can be a key lock or combination padlock such as those manufactured by Master Lock®. Rods 380 and 390 can be formed from materials such as but not limited to stainless steel, galvanized steel, metal alloys, hardened plastic, fiberglass and the like. Rubber cushion sleeves 362 and 364 can be formed from rubber, nylon, plastic and combinations thereof. Either or both the cushion sleeves 362, 364 and/or the rods 380, 390 and/or the cable components 340, 353, 355 can be coated with a neon colored paint and the like such as bright orange or yellow for added visibility. In operation, cylindrical hollow portion 394 receives rod portion 384 and holes 385/395 can be matched up so that a generic lock 330 having a U shaped end 335 can be inserted into the holes. The rubber cushion sleeves 362, 364 fit about the sides of a surfboard 10 in the tapered area shown as L1 in FIG. 1B and remain fixably secured in area L1 until locking device 300 is removed. The opening 352 of the metal bracket 350 can be fit over a fin 15 of the surfboard 10 to further lock the device 300 in place.

FOURTH PREFERRED EMBODIMENT

Figure 6A:
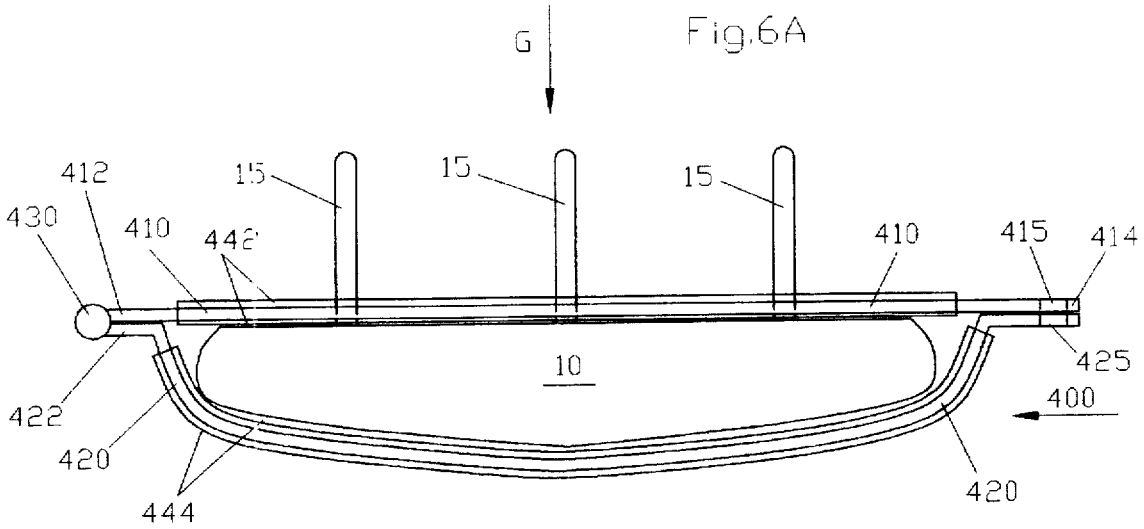
FIG. 6A a side view of a fourth preferred embodiment of the invention applied to the prior art surfboard/sailboard of FIG. 1A.
Figure 6B:
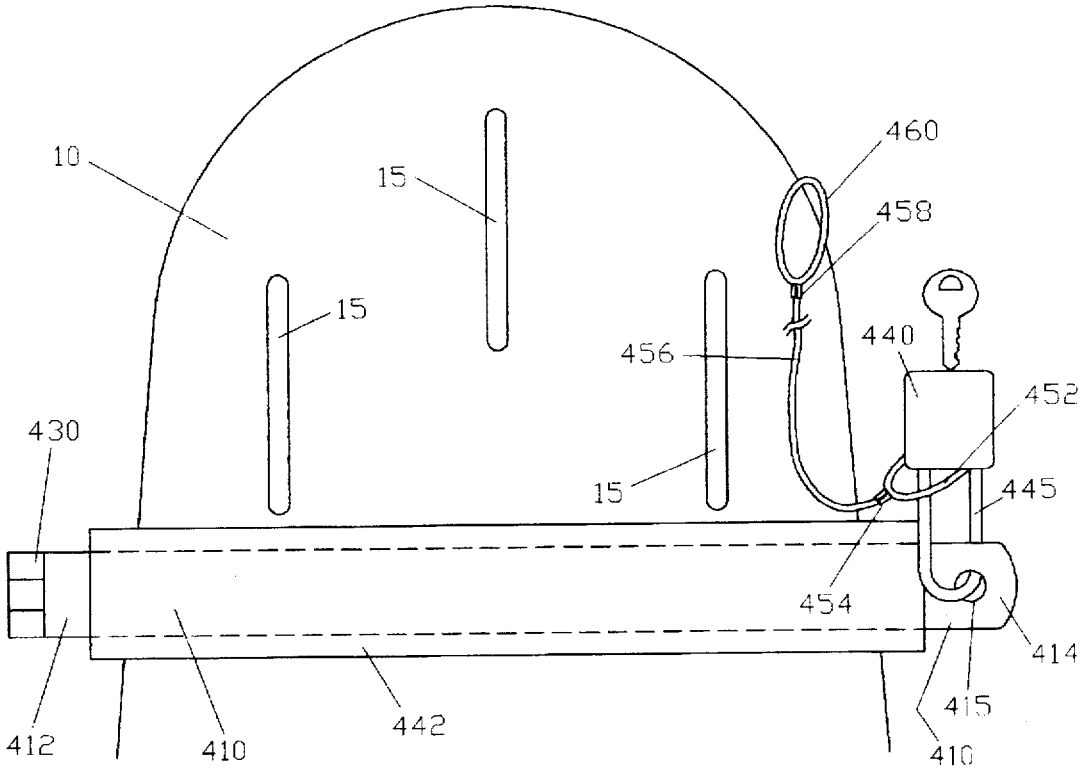
FIG. 6B is a top partial view of the fourth preferred embodiment of FIG. 6A along arrow G.

FIG. 6A a side view of a fourth preferred embodiment 400 applied to the prior art surfboard/sailboard of FIG. 1A. FIG. 6B is a top partial view of the fourth preferred embodiment 400 of FIG. 6A along arrow G. Referring to FIGS. 6A–6B, embodiment 400 includes flat metal plate 410 of approximately ¼ inch by 2 inch. Plate 410 has a cushion sleeve 442 wrapped about and a through hole 415 on one end 414 and a hinge 430 connected to the opposite end 412. Hinge 430 is also connected to end 422 of a curved plate 420 (similar to plate 410 but curved) which has a similar cushion sleeve 444 wrapped thereon. In operation, a key lock 440 similar to those previously discussed has a U shank 445 positioned into the through-holes 415 and 425. Key lock 440 also connects to a cable loop 452, loop clamp 454, cable 456, clamp 458 and cable loop 460 similar to those previously discussed. Plates 410 and 420 are positioned in the area L1 depicted in FIG. 1A–1B or the area L2 of FIGS. 2A–2B. The materials and colors of the plates and cable components of FIGS. 6A–6B can be similar to those described in regards to the rods and cable components previously discussed.

FIFTH PREFERRED EMBODIMENT

FIG. 7A is side view of a fifth preferred embodiment 500 applied to the prior art surfboard/sailboard of FIG. 1A. FIG. 7B is a top partial view of the fifth preferred embodiment 500 of FIG. 7A along arrow H. Referring to FIGS. 7A–7B, embodiment 500 includes flat metal plate 510 of approximately ¼ inch by 2 inch. Plate 510 has a cushion sleeve 542 wrapped about and a through hole 515 on one end 5 14 and a hinge 530 connected to the opposite end 512. Hinge 530 is also connected to end 522 of a curved plate 520(similar to plate 510 but curved) which has a similar cushion sleeve 544 wrapped thereon and a through-hole 525 on opposite end 524. In operation, a key lock 540 similar to those previously discussed has a U shank 545 positioned into the through-holes 515 and 525. Key lock 540 also connects to a cable loop 552, loop clamp 554, cable 556, clamp 558 and cable loop 560 similar to those previously discussed. Plates 510 and 520 are positioned in the area L1 depicted in FIG. 1A–1B or the area L2 of FIGS. 2A–2B. Plates 510 and 520 further include various additional through-holes 585 of approximately 9/32 inches diameter that can further include nuts and bolts 580 connected therethrough. These additional through-holes 585 allow for embodiment 500 to have variable widths so that smaller width boards can have a larger shank lock as depicted as the dotted lines 595 inserted therein. The materials and colors of the plates and cable components of FIGS. 7A–7B can be similar to those described in regards to the rods and cable components previously discussed.

SIXTH PREFERRED EMBODIMENT

Figure 8A:
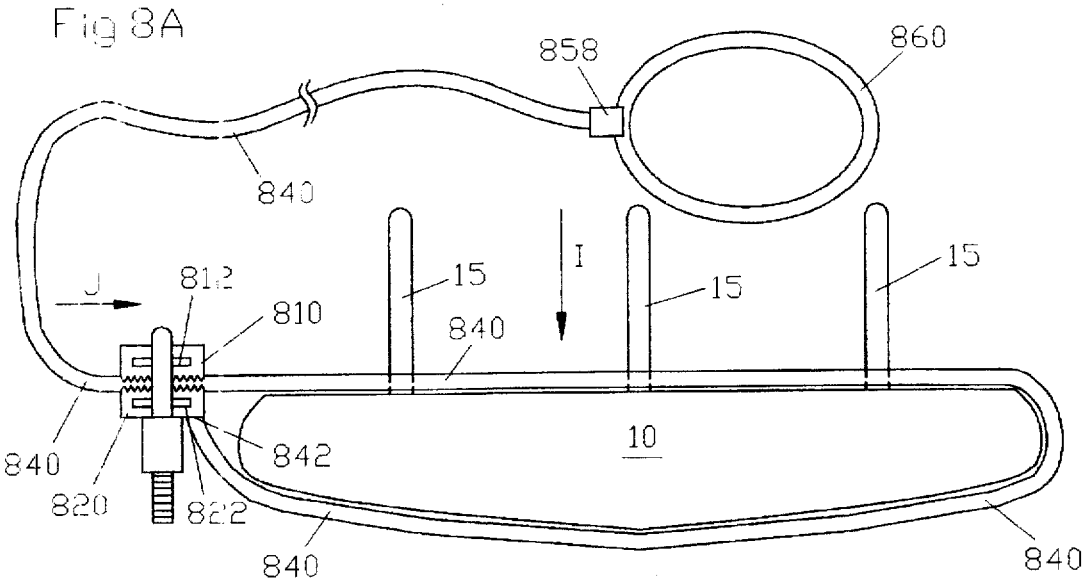
FIG. 8A is a side partial view of a sixth preferred embodiment of the invention applied to the prior art surfboard/sailboard of FIG. 1A.
Figure 8B:
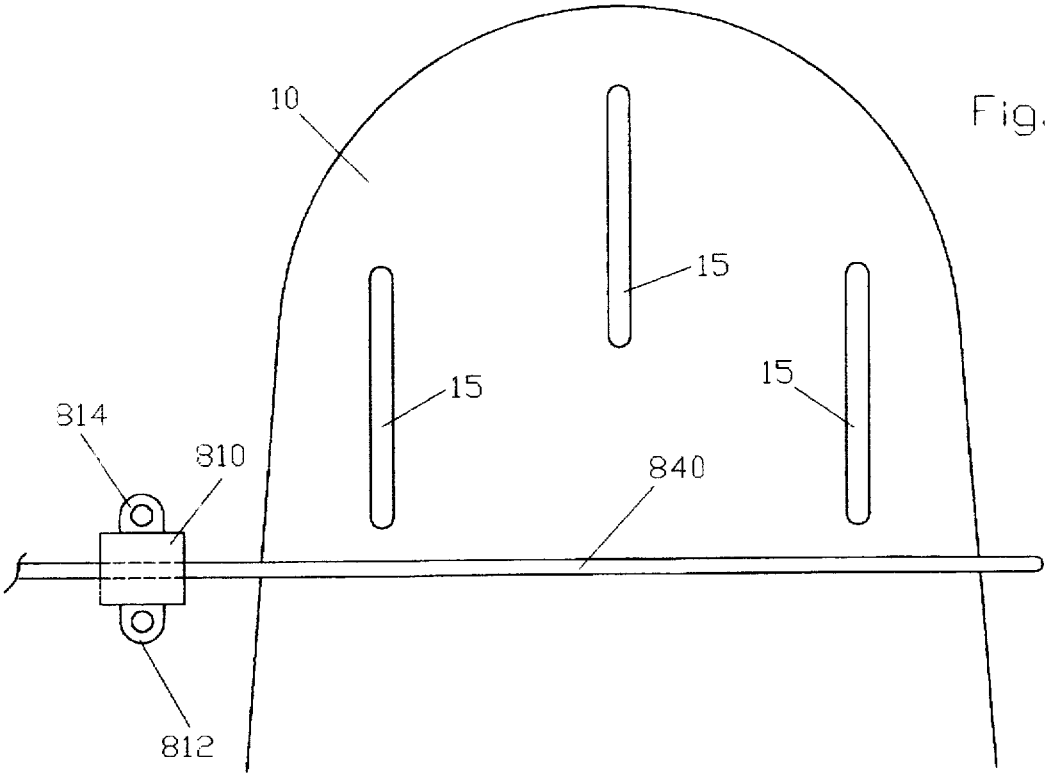
FIG. 8B is a top view of the sixth preferred embodiment of FIG. 8A along arrow I.
Figure 8C:
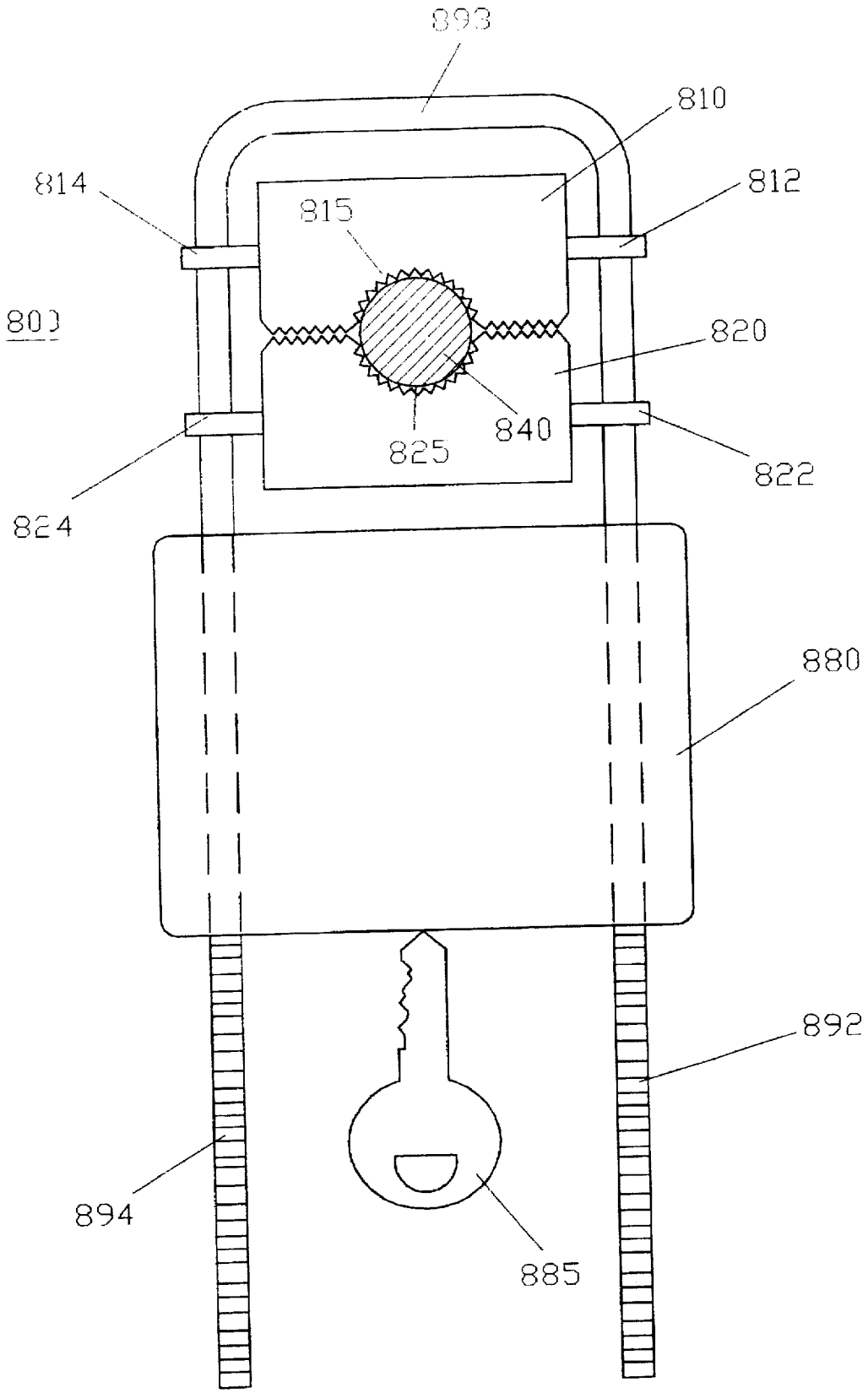
FIG. 8C is an end view of the clamp biting lock of FIG. 8A along arrow J.

FIG. 8A is a side partial view of a sixth preferred embodiment 800 of the invention applied to the prior art surfboard/sailboard 10 of FIG. 1A. FIG. 8B is a top view of the sixth preferred embodiment 800 of FIG. 8A along arrow I. FIG. 8C is an end view of the clamp biting lock 810, 820 of FIG. 8A along arrow J. Referring to FIGS. 8A–8C, embodiment 800 includes cable 840 with one end connected by a loop clamp 858 to a cable loop 860 which is similar to those components discussed previously. Clamp 840 has a second end 842 attached by soldering, welding and the like to lower cable biting component 820. Upper biting component 810 and lower biting component 820 have interior mateable cut-out grooves 815 and 825 respectively which bite sides of a portion of cable 840. A lock body 880 with key 885 has a U-shaped bar 893 with notches 892, 894 on each of its legs to hold upper biting component 810 and lower biting component 820 through their respective side flange loop-tabs 812, 814, 822, 824 to abut against one another with the cable portion 840 therebetween. Pushing U-shaped bar 893 downward causes the components 810 and 820 to move against one another, allowing the notches 892, 894 of the legs to adjust for tightening compression against cable 840. Lock body 880 can also be a padlock or combination lock discussed previously. Upper and lower biting components 810, 820 can be formed from stainless steel, galvanized steel and the like. Pulling loop end 860 causes the main body portion of cable 840 to tightly wrap about sides of board 10 with lock body 880 fixing the cable 840 in position.

While the invention has described embodiments of clamps and mounts that wrap directly about the body of the surfboard, the embodiments can include an extended C-portion for wrapping about a pole such as a parking sign pole, a bicycle rack, and the like.

Although the embodiments have been described for locking surfboards, the invention can be applied for locking other types of boards such as "boogie boards" (approximately three foot surfboard), skateboards, sailboards, sunfish, wind suffers, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A locking device in combination with a recreation board, the recreation board chosen from one of a surfboard and sailboard, the device comprises:

a top planar plate having a first end and a second end, the second end having a through-hole, the top plate overlying an upper surface of the recreation board having fins with first and second tapered sides, the recreation board having a narrow width end adjacent to the fins and a wide width middle;

a hinge having one side connected to the first end of the top plate adjacent the first tapered side of the recreation board in front of the fins;

a lower curved plate having a first end and a second end, the first end of the lower curved plate connected to a second side of the hinge, the second end of the lower curved plate having a through-hole, wherein the top plate and the lower curved plate rotate relative to the hinge and the through-holes of each plate match together, the lower curved plate abutting against a lower curved surface and the first and the second tapered sides of the recreation board; and a padlock for connecting through the top plate through-hole and the lower curved plate through-hole adjacent the second tapered side, the top plate and the lower curved plate being positioned between the narrow width end and the wide width middle of the recreation board.

2. The combination of claim 1, further comprising:

a first cushion sleeve for wrapping about the top plate; and the second cushion sleeve for wrapping about the lower curved plate.

3. The combination of claim 1, further comprising:

a cable having first and second loop ends, the first end attached to the top plate.

4. A locking device in combination with a recreation board, the recreation board chosen from one of a surfboard and sailboat, the device comprises:

a top straight rod having a first end and a second end, the second end having a through-hole, the top rod overlying an upper flat surface of the recreation board having fins with first and second tapered sides, the recreation board having a narrow width end adjacent to the fins and a wide width middle;

a hinge having one side connected to the first end of the top rod adjacent the first tapered side of the recreation board in front of the fins;

a lower curved rod having a first end and a second end, the first end of the lower curved rod connected to a second side of the hinge, the second end of the lower curved rod having a through-hole, wherein the top rod and the lower curved rod rotate relative to the hinge and the through-holes of each rod match together, the lower curved rod abutting against a lower curved surface and the first and the second tapered sides of the recreation board; and a padlock for connecting through the top rod through-hole and the lower curved rod through-hole adjacent the second tapered side, the top rod and the lower curved rod being positioned between the narrow width end and the wide width middle of the recreation board.

5. The combination of claim 4, further comprising:

a first cushion sleeve for wrapping about the top rod; and a second cushion sleeve for wrapping about the lower curved rod.

6. The combination of claim 4, further comprising:

a cable having and second loop ends, the first loop end attached to the top rod.

* * * * *